US006625816B1

(12) United States Patent
Cooke

(10) Patent No.: US 6,625,816 B1
(45) Date of Patent: Sep. 30, 2003

(54) SCENT-FREE CAMOUFLAGED LATEX GLOVES

(76) Inventor: Charles G. Cooke, 405 Wise Ave., Baltimore, MD (US) 21222

( * ) Notice: Subject to any disclaimer, the term of this patent is extended or adjusted under 35 U.S.C. 154(b) by 0 days.

(21) Appl. No.: 10/270,592

(22) Filed: Oct. 16, 2002

(51) Int. Cl.[7] ..... A41D 19/00
(52) U.S. Cl. ..... 2/161.5; 2/900
(58) Field of Search ..... 2/900, 161.1, 167, 2/161.7, 161.8, 161.5

(56) References Cited

U.S. PATENT DOCUMENTS 3,872,515 A * 3/1975 Miner et al. ..... 2/168
4,864,661 A 9/1989 Gimbel
4,935,260 A 6/1990 Shlenker
5,173,966 A 12/1992 DeLeo
5,335,373 A 8/1994 Dangman et al.
5,347,659 A * 9/1994 Tibljas ..... 2/84
5,357,636 A * 10/1994 Dresdner et al. ..... 2/161.7
5,409,760 A 4/1995 Neitz et al.
5,566,394 A * 10/1996 Flick ..... 2/168
5,581,811 A 12/1996 Cohen et al.
5,682,613 A 11/1997 Dinatale
5,985,381 A 11/1999 Conner
6,000,057 A 12/1999 Newman
6,127,022 A 10/2000 Pretorius
6,134,718 A * 10/2000 Sesselmann ..... 2/243.1

* cited by examiner

*Primary Examiner*—John J. Calvert
*Assistant Examiner*—Katherine Moran
(74) *Attorney, Agent, or Firm*—Richard C. Litman

(57) ABSTRACT

Scent-free, camouflaged, and single-layered latex gloves for various personnel desiring to prevent odorous detection by animals or protection from dangerous materials such as bacteria, viruses and the like when handling infected persons. The colored gloves are camouflaged with various colored patterns. Additionally, indicia such as logos and advertisements can be imprinted on the gloves.

2 Claims, 3 Drawing Sheets

SCENT-FREE CAMOUFLAGED LATEX GLOVES

BACKGROUND OF THE INVENTION

1. Field of the Invention

The present invention relates generally to gloves. More specifically, the invention is at least one glove, or a pair of gloves, which, according to the present invention, are scent-free, multi-colored, i.e., camouflaged, and indicia imprinted single-layer latex gloves, which can be utilized by hunters, fishermen, military personnel, emergency medical units, and the like.

2. Description of the Related Art

The related art of interest describes various gloves, but none discloses the present invention. There is a need for gloves which are tightly fitting, scent-free, multi-colored and indicia imprinted latex gloves which can be used by persons to prevent detection by animals, and to prevent contamination by bacteria, viruses and the like. The related art is described in the order of perceived relevance to the present invention.

U.S. Pat. No. 5,173,966 issued on Dec. 29, 1992, to David B. DeLeo describes a coded (visual indicia) health-care pair of gloves constituted of thin transparent or translucent latex or other elastic rubber-like material. A thumb portion and a pinkie portion are marked at side edges with different internal colors for each hand for enabling the user to initially pick up the right glove and easily wear it on the user's hand in the proper position. The right glove's thumb has an internal gold or yellow stripe and the wrist portion has raised ribs. The left glove has external raised dots or ribs and an internal blue stripe on its thumb. The left glove's wrist portion has another blue stripe and a self-sticking or pressure reactive label inside. The gloves are distinguishable for having features mainly for the purpose of identifying the right glove from the left glove for a health-care user, even though a thin transparent or translucent latex or rubber-like glove is essential.

U.S. Pat. No. 4,864,661 issued on Sep. 12, 1989, to Neal I. Gimbel describes a puncture resistant surgical latex glove having puncture resistant woven guard portions on the thumb, forefinger and middle finger at the joints. The gloves are distinguishable for requiring guard portions at specific apportions of a surgical glove.

U.S. Pat. No. 5,581,811 issued on Dec. 10, 1996, to Carl J. Cohen et al. describes a protective glove for preventing inadvertent punctures of a health care worker's hand comprising sharkskin and/or leather on a latex glove, and, optionally, contain a viricide, bactericide or a mesh layer between the aforementioned layers. The glove is distinguishable for requiring multiple layers of sharkskin, leather, latex, and either a viricide, bactericide or a mesh layer internally.

U.S. Pat. No. 4,935,260 issued on Jun. 19, 1990, to Robin R. T. Shlenker describes a covering composition for various parts of the human body including a multi-layered glove body comprising a latex outer layer, an intermediate layer containing either alternating chambers, sponge, or cellulose containing a chemical barrier agent, and a latex inner layer. The glove is distinguishable for requiring three layers and an encapsulated inner chemical barrier.

U.S. Pat. No. 5,335,373 issued on Aug. 9, 1994, to Kenneth H. Dangman et al. describes protective medical gloves containing a liquid antiseptic composition between two flexible layers. The liquid composition can be a surface-active agent, an analgesic agent, a colorant, a vasoconstrictive agent, a smell-causing agent, and a viscosity-modifying agent. The gloves are distinguishable for requiring a liquid agent between two flexible layers.

U.S. Pat. No. 5,357,636 issued on Oct. 25, 1994, to Karl P. Dresdner, Jr. et al. describes a flexible protective medical glove containing an inner non-liquid antiseptic composition. The glove is distinguishable for requiring an inner antiseptic composition.

U.S. Pat. No. 5,682,613 issued on Nov. 4, 1997, to Chuck Dinatale describes a waterproof breathable glove comprising a laminate of a porous elastomeric, a fabric layer, and a waterproof breathable film. The glove is distinguishable for requiring multiple layers.

U.S. Pat. No. 6,000,057 issued on Dec. 14, 1999, to Anthony E. Newman describes an odor preventing hunting apparel constructed from antimicrobial fabrics having specific spectral reflectance curves and values. The apparel is distinguishable for requiring antimicrobial fabrics with specific spectral reflectance curves and values.

U.S. Pat. No. 6,127,022 issued on Oct. 3, 2000, to Zagarias H. J. Pretorius describes a camouflage surface for concealment from, and deception of, a herbivorous animal.

U.S. Pat. No. 5,409,760 issued on Apr. 25, 1995, to Jay Neitz et al. describes camouflage materials for reducing visual detection by deer and other dichromatic animals containing at least two coloring agents which limit photo-optic light emissions to at least two bands of wavelengths. The camouflage materials are distinguishable for being limited to coloring agent which limit photooptic light emissions to at least two bands of wave-lengths.

U.S. Pat. No. 5,985,381 issued on Nov. 16, 1999, to Kyle H. Conner describes clothing articles having an increasing camouflaging effect according to the ambient light level which is made by adding a photochromic material having a first chromic state under low light conditions, and a second chromic state under higher light conditions, onto a clothing pattern. The article and method are distinguishable for being restricted to clothes and photochromic materials.

None of the above inventions and patents, taken either singly or in combination, is seen to describe the instant invention as claimed. Thus, scent-free camouflaged latex gloves solving the aforementioned problems is desired.

SUMMARY OF THE INVENTION

The present invention is a single glove or a pair of gloves which can be used by hunters, fishermen, military personnel, emergency medical personnel, and the like for the prevention of emanating or leaving human odors, and the prevention of contamination from harmful bacteria, viruses and hazardous biological materials. The glove allows the user to touch various objects during a hunt, a military operation, and the like, without leaving a human scent which would jeopardize the user's intended operation. Moreover, emergency medical personnel will be protected from contamination when treating and handling patients having contagious diseases. In the broadest context, usage of these gloves comprises any task in which the user needs hand concealment, general cleanliness, and a scent-free barrier between the hand and its environment. In one embodiment, indicia such as logos and advertisement can also be added. Other indicia includes botanical, ornithological, oceanographical, geological, animals, mammals, reptiles, racing, sporting items, geometrical designs, and the like. A specific example is illustrated for the invaluable use of a bowhunter who must come as close to the animal being hunted as possible without being detected and which requires a pair of camouflaged latex gloves which will not leave the bowhunter's scent on any article or surrounding object to warn an animal having a superior sense of smell.

Accordingly, it is a principal object of the invention to provide scent-free camouflaged latex gloves.

It is another object of the invention to provide scent-free camouflaged latex gloves which have a base color which can be any background color.

Still another object of the invention is to provide scent-free camouflaged latex gloves for hunting, fishing, nighttime military operations, and the like activities.

Yet still another object of the invention is to provide camouflaged gloves with various indicia including botanical, ornithological, oceanographical, geological, animals, mammals, reptiles, racing, sporting items, printed logos, advertisements, geometrical designs, and the like.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
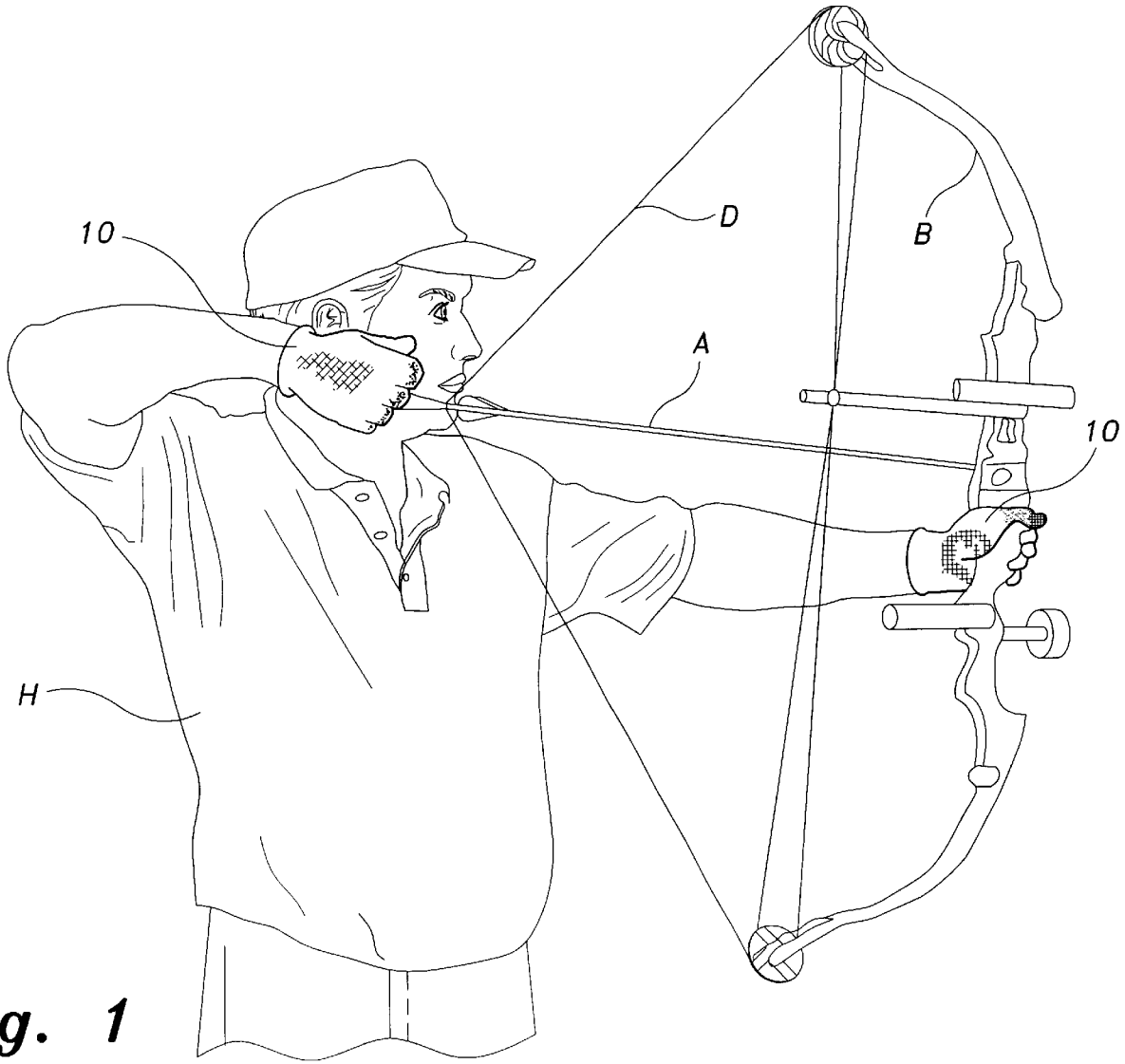
FIG. 1 is an environmental, perspective view of a hunter with a bow and arrow using scent-free camouflaged latex gloves according to the present invention.

The present invention, as depicted in FIG. 1, is a pair of camouflaged latex gloves 10, shown as used by a hunter H both to protect the hunter's hands from contamination, and to prevent the hunter from leaving his scent behind on any object that he touches which might be detected by game animals having a keen sense of smell. FIG. 1 shows the hunter H aiming a bow B and arrow A. Advantageously, the latex gloves 10 are relatively thin, flexible and elastic, tightly conforming to the hunter's hands so that the hunter H can easily manipulate the drawstring D and arrow A by touch.

Figure 2:
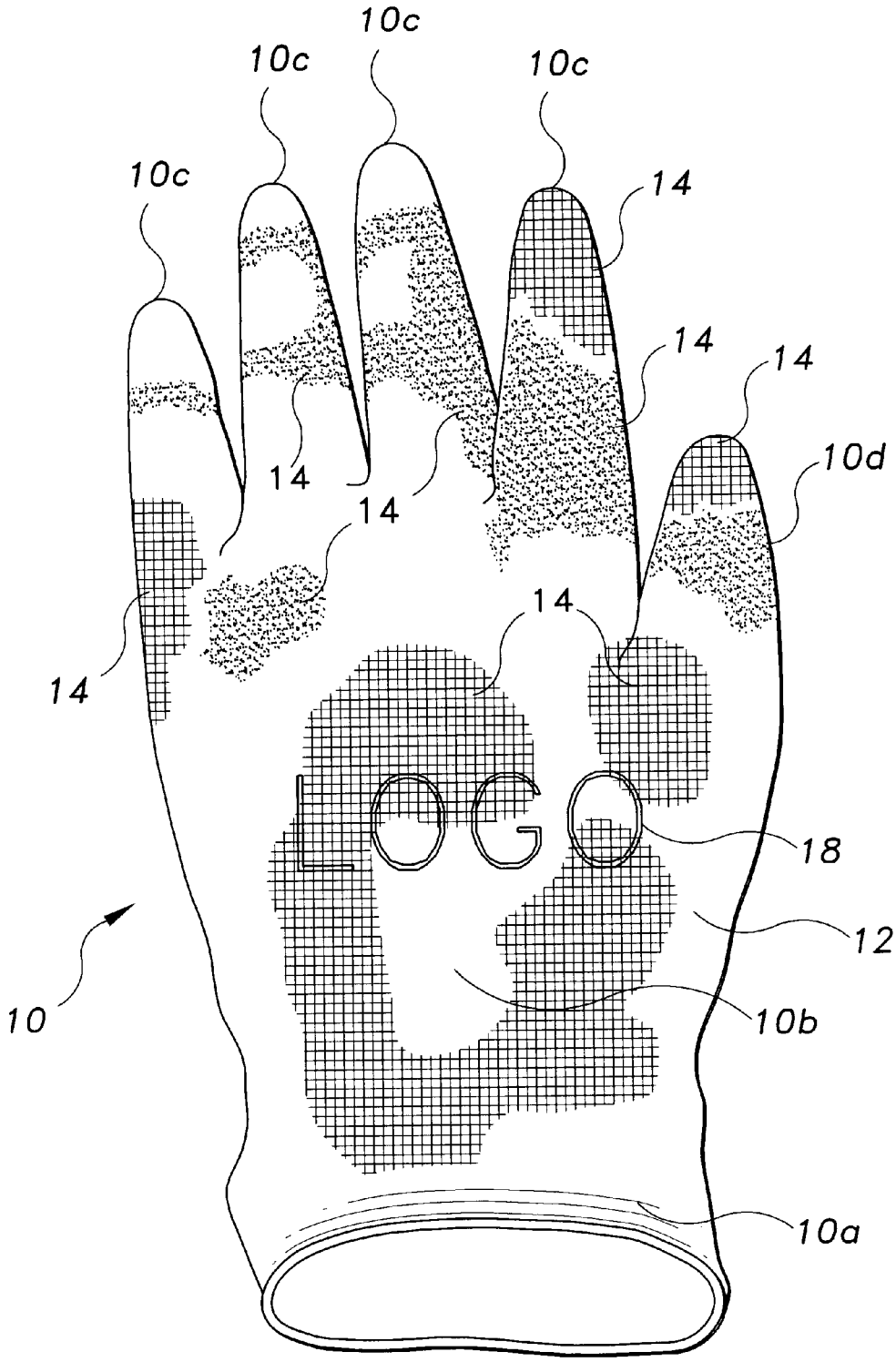
FIG. 2 is a front elevational view of a glove according to the present invention.
Figure 3:
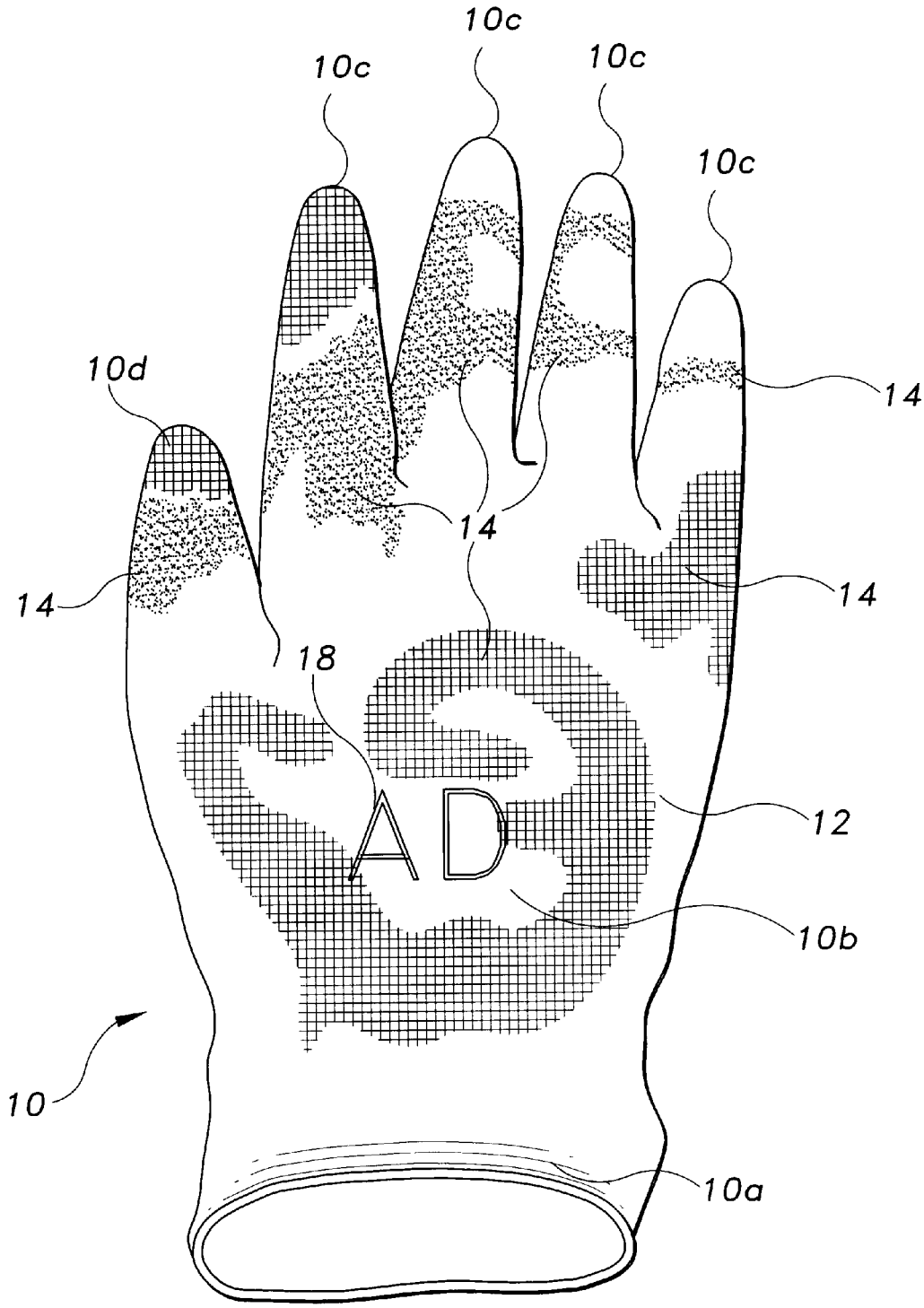
FIG. 3 is a rear elevational view of a glove according to the present invention.

As shown more clearly in FIGS. 2 and 3, the camouflage latex glove 10 of the present invention is made from a single layer of latex, and has a base color on the exterior surface 12 of the glove 10. The glove 10 has a standard glove shape, including a cuff 10*a* portion for disposition over the wrist, a palm portion 10*b* for enclosing the palm and the back of the hand, four fingers 10*c*, and a thumb 10*d*, so that the hand is completely covered from the wrist to the fingertips. A plurality of patches 14 of irregular shape are randomly disposed over the base exterior surface 12. The patches 14 are of various colors, such as brown, black, green, dark and light grey, orange, white, beige, pink, purple, and the like, which are designed to blend in with the base color of the exterior surface 12 of the glove 10 to create a mosaic of colors which blends in with foliage, so that game animals would be less likely to notice movement of the hunter's hands. The patches 14 can be applied by coating the exterior surface 12 with any dye capable of permanently adhering to latex, as is known in the art. Since the latex glove 10 is symmetrical at front and rear, the glove 10 can be worn on either the left hand or the right hand.

The gloves 10 can be disposable, and can be packaged in a suitable dispenser which minimizes handling of the gloves 10 in order to prevent the exterior surface 12 from becoming contaminated with the hunter's scent through excessive handling. As shown in FIGS. 2 and 3, the camouflaged latex gloves 10 of the present invention can have indicia 18, such as a logo or advertisement, imprinted on the palm or the back of the hand.

Although the camouflage latex glove 10 has been described with reference to its use by hunters, and therefore illustrated with a simulated foliage camouflage pattern, it will be understood that the camouflage pattern may vary with the intended use in order to blend in with the environment. For example, the camouflage pattern may consist of a solid black pattern for use by the military in night operations, e.g., by commandos.

The latex gloves 10 are water impermeable, so that they offer some protection for keeping the hunter's hands dry in inclement weather. The latex gloves 10 can be textured or smooth to meet the needs of the user. The latex gloves 10 would be supplied in a range of sizes. Further, the latex gloves 10 offer protection from mud, soil, tree and plant resins, and other contaminants, including harmful bacteria, viruses, or other infectious agents which can be encountered in the blood or viscera of an animal or fish while gutting or dressing the carcass.

It is to be understood that the present invention is not limited to the embodiments described above, but encompasses any and all embodiments within the scope of the following claims.

I claim:

1. A scent-free and camouflaged latex glove consisting of:

a single layer of latex designed and configured to form a glove having a cuff portion, a palm portion, a thumb and four fingers, wherein the single layer of latex is symmetrical and adapted for being worn on either a right or left hand;

the glove having a textured exterior surface comprising a single base color; and the glove having randomly sized and shaped patches of accessory colors other than the base color coated on the exterior surface and defining a camouflage pattern;

whereby the wearer of the glove is protected from leaving a scent on objects touched by the glove, from emanating human scent from a hand inside the glove, and from contacting dangerous bacteria, viruses and biological hazardous materials with the gloved hand.

2. A scent-free and camouflaged latex glove consisting of:

a single layer of latex forming a cuff portion, a palm portion, a thumb and four fingers defining a glove;

the glove having an exterior surface comprising a single base color; and the glove having randomly sized and shaped patches of accessory colors other than the base color coated on the exterior surface and defining a camouflage pattern and further including indicia imprinted on the exterior surface;

whereby a wearer of the glove is protected from leaving a scent on objects touched by the glove, from emanating human scent from a hand inside the glove, and from contacting dangerous bacteria, viruses and biological hazardous materials with the gloved hand.

* * * * *